United States Patent [19]

Efinger et al.

[11] 4,328,430

[45] May 4, 1982

[54] APPARATUS FOR ACTUATING ELECTRICAL LOAD-SEPARATING SWITCHES IN AN ELECTRICITY SUPPLY NETWORK

[75] Inventors: Arnold Efinger, Trossingen; Erwin Moser, Karlsruhe-Rüppurt; Egon Wessing, Münster, all of Fed. Rep. of Germany

[73] Assignee: Wickmann-Werke Boblingen GmbH, Boblingen, Fed. Rep. of Germany

[21] Appl. No.: 137,606

[22] Filed: Apr. 7, 1980

[30] Foreign Application Priority Data

Apr. 7, 1979 [DE] Fed. Rep. of Germany ..... 2914199

[51] Int. Cl.[3] ..... H01H 33/00

[52] U.S. Cl. ..... 307/114; 307/9; 318/139

[58] Field of Search ..... 307/38, 41, 114, 115, 307/9, 10 R; 318/466, 467, 468, 139, 14

[56] References Cited

U.S. PATENT DOCUMENTS 3,663,827 5/1972 Ford et al. ..... 307/41

*Primary Examiner*—Michael L. Gellner
*Assistant Examiner*—James L. Dwyer
*Attorney, Agent, or Firm*—Becker & Becker, Inc.

[57] ABSTRACT

An apparatus for actuating electrical load-separating switches in an electricity supply network, and including at least one manual actuation lever. An electrical actuating motor is provided which is capable of being supplied with operating current from an auto battery, and is located at the load-separating switch in addition to the manual actuation levers. A remote control cable, which extends from the electrical actuating motor, is equipped with a plug connector having a plug which can be taken along in the maintenance-service vehicle belonging with the auto battery. The load-separating switches are selectively capable of being actuated over the remote operating cable from a switching and indicating panel carried along in a maintenance-service vehicle. A follower for the manual actuation lever of the load-separating switch is connectible to a closed-loop drive chain, and when coupled thereto is movable between abutments.

4 Claims, 1 Drawing Figure

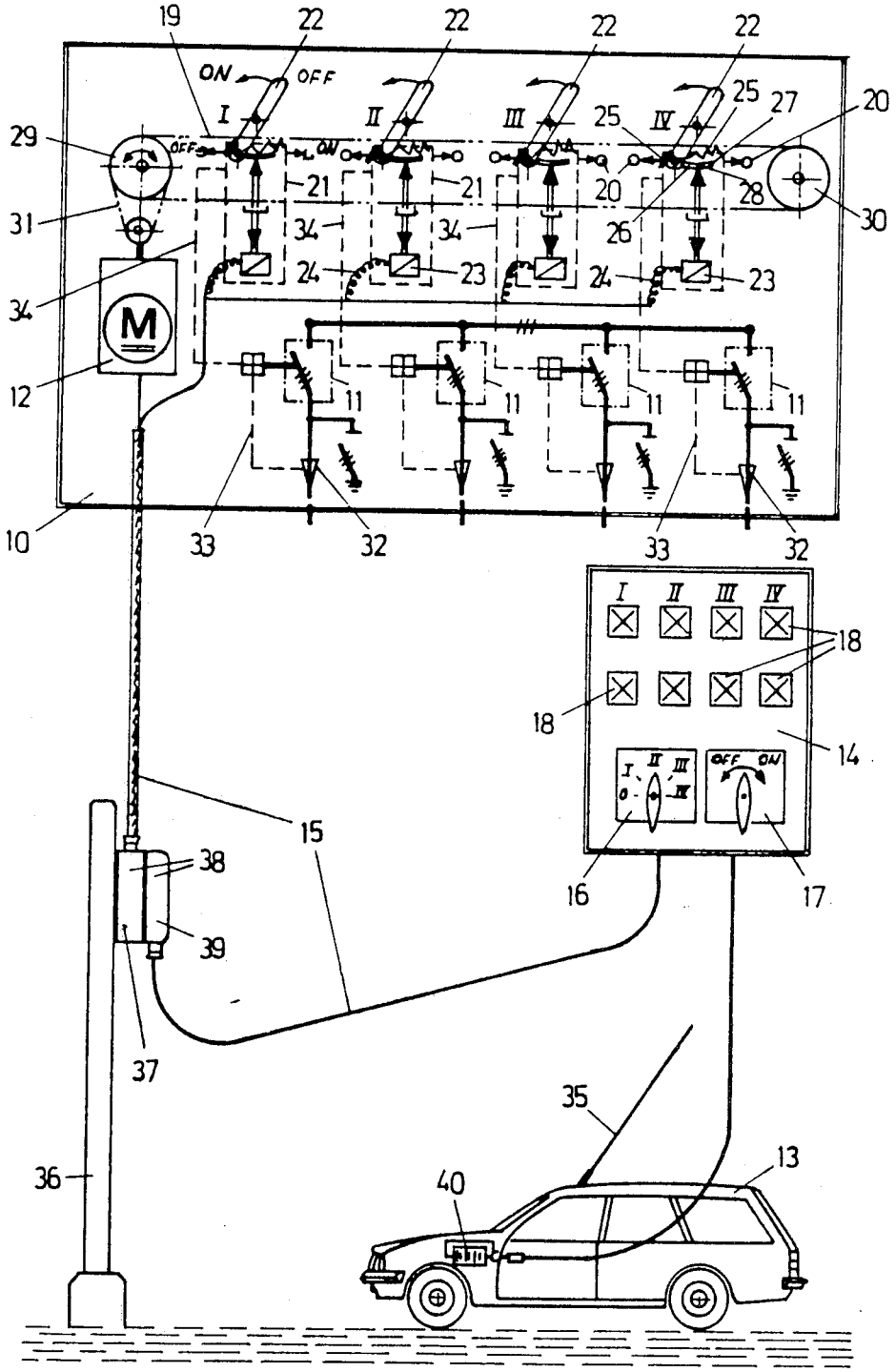
19
22
22
22
22
ON
OFF
I
II
III
IV
25
27
20
29
OFF
ON
21
21
20
28
30
31
34
34
26
24
23
24
23
34
M
12
11
11
11
11
10
33
32
33
32
I
II
III
IV
18
18
14
OFF
ON
15
38
16
17
39
37
35
36
40
13

APPARATUS FOR ACTUATING ELECTRICAL LOAD-SEPARATING SWITCHES IN AN ELECTRICITY SUPPLY NETWORK

The present invention relates to an apparatus for actuating electrical disconnecting or load-separating switches in an electricity-supply network, and includes at least one manual actuation lever.

With such apparatus, mostly three pole switches of a three-phase switch are equipped with a common manual actuation lever. If several of these three-phase switches are combined in a space, for example in a transformer station, each of the three-phase switches has a separate manual actuation lever. All manual actuation levers can be made very short if one extension piece with a handle or grip is kept ready to be inserted and fits all the levers.

In case of disturbance, the transformer stations are located with a maintenance-service vehicle connected by radio telephone with a control station or central office. The drawback to this situation is that the maintenance-service man cannot use the radio telephone connection when he is in the transformer station. In order to report about his actions taken for switching on and off, and to receive new instructions, the maintenance-service man must frequently walk back to a maintenance-service vehicle which is parked far away. Such a situation, during the night and during fog, in spread out factories or in high-rises or their basements, is considered as extremely inconvenient.

The object of the present invention is to create an actuation apparatus of the aforementioned type which is improved with respect to convenience, easier serviceability, higher safety in case of accident, and easier as well as more efficient for transmission of instructions.

This object, and other objects and advantages of the present invention, will appear more clearly from the following specification in connection with the accompanying drawings, which illustrates schematically an apparatus for actuation of electrical disconnecting load-separating switches in an electricity supply network having features in accordance with the teaching of the present invention.

The apparatus of the present invention is characterized primarily by an electrical actuating motor which is capable of being supplied with an operating current from an auto battery, and is located at the load-separating switch in addition to the manual-actuation levers; furthermore, a remote control cable, equipped with a plug connector having a plug which can be taken along in the maintenance-service vehicle belonging with the auto battery, leads from the electrical actuating motor.

With the inventive apparatus, it is possible to undertake switching-on and switching-off operations at one transformer station without opening the enclosure of the transformer station and without being subjected to the danger of engaging or touching parts conveying high voltages. The plug counterpiece of the plug connector can be installed remote from the transformer station at a location where a maintenance-service vehicle can drive right up to it. As soon as the remote control cable is completed by combining or plugging together both parts of the plug connector, a load-separation switch can be switched on or off, while maintaining the radio telephone connection to the maintenance-service central office, from the maintenance-service vehicle by means of the electrical actuation motor. Consequently, consumer shut-down operations are less apparent, and disturbance location is considerably accelerated. Advantages attained with the present invention, however, are especially recognizable therein that the actuating motor, as a consequence of its connection to the auto battery of the maintenance-service vehicle, operates with low voltage and is independent of the electricity supply network.

Pursuant to further features of the present invention, a common actuating motor may be provided for two or more load-separating switches. The load-separating switches 11 may be selectively actuated over the remote control cable from a switching and indicating panel carried along in the maintenance-service vehicle. A closed-loop drive chain may be provided on the output side of the actuating motor. A follower for the manual actuation lever of the load-separating switch may be provided and is capable of being coupled to the drive chain for every load-separating switch; when coupled, it is movable between two path limiting abutments. The manual actuation lever of the load-separating switch may be stressed or braced by tension springs on both sides with the follower, which may have a switching curve or cam with two end abutments and a top or crown located therebetween for assuring the two alternate switching positions. At each switching pole in the load-separating switch, the contact position of a cable connection plug is secured by a clamping or terminal bracket, which may have an interrupter extension, effective upon disengagement or release, to the coupling of the follower.

Referring now to the drawing in detail, in a mostly schematically simplified illustration there is shown a transformer station 10 with four disconnecting or load-separating switches 11, in the form of three-phase switches, for which a common actuating motor 12 is provided for economy. In order to be able to subject the four load-separating switches 11 (the switches being differentiated from each other by I, II, III, IV) to individual remote control, the load-separating switches 11 are selectively actuatable by way of a remote control cable 15 from a switching and indicating panel 14 brought along in a maintenance-service vehicle 13. The switching and indicating panel 14, for this purpose, includes a step switch 16 with a neutral base position 0 and four selection positions for the load-separating switches 11 differentiated from each other by the Roman numerals I, II, III and IV; the panel 14 also includes a keying switch 17 with two keying positions "off" and "on", separated from each other by a central rest position, for both opposite manners of operation of the actuating motor 12, and further includes eight indicator lights 18 in a lamp panel for simultaneous indication of the particular positioning of all four load-separating switches 11.

The individual actuation of the load-separating switches 11 by means of the actuating motor 12, which operates all load-separating switches 11 in common, is accomplished in an especially economical manner in that at the actuating motor 12, at the output side thereof, a closed-loop drive chain 19 is provided, and on the drive chain 19, for each load-separating switch 11, there is provided a follower 21 for the manual actuation lever 22 of the load-separating switch 11; this follower 21 is capable of being coupled to the drive chain 19 and, when coupled, of being moved by the drive chain 19 between two abutments or path-limiting means 20. A magnetic coupling 23 respectively serves for coupling.

This magnetic coupling 23 is fastened to the follower 21 and includes a conductor connection 24 to the remote control cable 15 for receiving the shifting movements of the follower 21. The magnetic coupling 23, when connected by means of the step switch 16, engages the drive chain 19 between the links thereof. As a path-limiting means 20, there is respectively provided a switch which turns off the actuating motor 12 until the latter is started again in the opposite direction by the keying switch 17 of the switching- and indicating-panel 14, or until activated in one of the two directions of movement of the follower 21 of a different load-separating switch 11.

A very economical construction is also attained with the inclusion of a quick-break switch device serving for switching speed and switching safety, since the manual actuation lever 22 of the load-separating switch 11 is braced on both sides with the follower 21 by tension springs 25, and the follower 21 has a shifting curve or cam 26 with two end abutments 27 and a crown or top 28 located therebetween for assuring both alternate switching positions. After overcoming or passing over the top or crown 28, the manual actuation lever 22 snaps promptly into the other end position, whereas the drive chain 19, which is guided over two chain or sprocket wheels 29, 30, moves comparatively slowly as a consequence of the stepdown gearing 31 inserted between the drive chain 19 and the actuating motor 12.

A further embodiment of the apparatus for actuation of electrical load-separating switches 11 in an electricity supply network finally consists therein that at each switching pole existing in the load-separating switch 11 there is assured the contact positioning or setting of a cable connection plug 32 by means of a clamping or terminal bracket 33. The clamping bracket 33 has an interrupter extension 34, effective upon disengagement, to the coupling 23 of the follower 21. In this way, a remote actuation of the load-separating switch 11 embodied as a three-phase switch is eliminated with extremely simple means when, at least at one of the three switching poles thereof, the cable connection plug 32 is loosened or withdrawn. A destructive arcing would be the consequence of a withdrawn or loosened cable connection plug 32 upon switching on of the load-separating switch 11, because of the short insulating distance or gap. Since this condition is not recognizable with a remote actuation of the pertaining load-separating switch 11, the interrupter extension 34 represents an extremely meaningful safety device.

When a disturbance location in an electricity supply network is pinpointed, a maintenance-service vehicle 13 equipped with a radio telephone system 35 drives close to the mating plug or plug counterpiece 37 of the multiple pole plug connector 38 installed, for example, on a post 36, externally of the transformer station 10, so that the remote control cable 15 can be completed, by insertion of the plug 39 carried in the maintenance-service vehicle 13 into the plug counterpiece 37, from the operator's seat of the maintenance-service vehicle 13. Upon joinder of the plug connector 38, the auto battery 40 of the maintenance-service vehicle 13 is connected or integrated into the apparatus for actuation of the electrical load-separating switches 11. As soon as actuations of the load-separating switches 11 of the transformer station 10, likewise undertaken by means of the switching and indicating panel 14 from the operator's seat of the maintenance-service vehicle 13, lead to new findings in the maintenance-service central office location, then without any loss in time, upon orders given by radio telephone, the maintenance-service vehicle 13 can proceed to a further switching location.

The present invention is, of course, in no way restricted to the specific disclosure of the specification and drawings, but also encompasses any modifications within the scope of the appended claims.

What we claim is:

1. An apparatus for actuating electrical load-separating switches in an alternating current electricity-supply network of high voltage, each of said switches having a manual actuation lever for non-remote switching off or on to said network inside a dangerous inner area of a transformer and/or distributor station also having a non-dangerous outer area as well as being provided in combination with a maintenance-service vehicle, said apparatus comprising:

an auto battery of a maintenance-service vehicle installed and carried along therewith as a direct current source of low voltage in addition to the network of high voltage;

an electrical actuating motor operatively connected to at least one of said switches and capable of being supplied with operating current from said auto battery;

a remote control cable which leads from said motor to the non-dangerous outer area of said transformer and/or distributor station and which is provided with a plug connector adapted to receive a plug which can be carried along in said vehicle; and a switching and indicating panel connected to said plug and also adapted to be carried along in said vehicle, said load-separating switches being selectively actuatable over said remote control cable from said panel.

2. An apparatus for actuating electrical load-separating switches in an electricity-supply network with a maintenance-service vehicle having an auto battery, said apparatus comprising:

at least one manual actuation lever operatively connected to said switches;

an electrical actuating motor operatively connected to said switches and capable of being supplied with operating current from said battery;

a remote control cable which leads from said motor and is provided with a plug connector adapted to receive a plug which can be carried along in said vehicle;

a common actuating motor for at least two load-separating switches;

a switching and indicating panel connected to said plug and adapted to be carried along in said vehicle, said load-separating switches being selectively actuatable over said remote control cable from said panel, and a closed-loop drive chain on the output side of said actuating motor; for each load-separating switch, a follower for said at least one lever, said follower being capable of being coupled to said drive chain; two path limiting abutments for each switch, said follower, when coupled to said drive chain, being movable between two pertaining abutments.

3. An apparatus according to claim 2, which includes: tension springs for tensioning said lever on both sides with said follower; and a switching cam provided on each of said followers and having two end abutments, and a crown therebetween, for assuring two alternate switching positions.

4. An apparatus according to claim 3, which includes: a cable connection plug for each switch; a clamping bracket for securing the contact position of a cable connection plug at each switching pole in a switch; a coupling for each follower; and respective interrupter extensions associated with said brackets, leading to said couplings, and effective upon disengagement of said plugs.

* * * * *